United States Patent [19]

Leitko, Jr. et al.

[11] Patent Number: 4,834,193

[45] Date of Patent: May 30, 1989

[54] EARTH BORING APPARATUS AND METHOD WITH CONTROL VALVE

[75] Inventors: Curtis E. Leitko, Jr.; Michael R. Wasson, both of Houston, Tex.; Douglas W. Lee, Enid; Gerald A. Stangl, Perry, both of Okla.

[73] Assignee: Gas Research Institute, Chicago, Ill.

[21] Appl. No.: 136,401

[22] Filed: Dec. 22, 1987

[51] Int. Cl.[4] ..... E21B 4/06; E21B 7/06; E21B 7/26; E21B 44/00

[52] U.S. Cl. ..... 175/19; 175/26; 175/61; 175/73; 175/94; 173/91

[58] Field of Search ..... 166/323, 325; 175/19, 175/21, 26, 61, 62, 73, 74, 75, 92, 94, 100; 173/91

[56] References Cited

U.S. PATENT DOCUMENTS

| | | | |
|---|---|---|---|
| 3,137,483 | 6/1964 | Zinkiewicz | 175/19 |
| 4,629,008 | 12/1986 | Kostylev et al. | 175/19 X |
| 4,632,191 | 12/1986 | McDonald et al. | 175/9 |
| 4,637,476 | 1/1987 | Gurkov et al. | 175/19 X |
| 4,694,913 | 9/1987 | McDonald et al. | 175/19 X |

*Primary Examiner*—William P. Neuder
*Attorney, Agent, or Firm*—Neal J. Mosely

[57] ABSTRACT

An earth boring apparatus has a pneumatically operated earth boring tool, a flexible conduit or drill pipe connected to the tool and to a source of pneumatic fluid. The tool has an earth boring member and a reciprocally movable hammer positioned in the tool to apply a percussive force. A valve assembly in the flexible conduit or drill pipe substantially adjacent to the tool between the tool and the source of pneumatic fluid controls the flow of pneumatic fluid to the tool. The valve assembly has a pneumatic pressure-operated valve which is operable in response to the pressure of pneumatic fluid in the flexible conduit or drill pipe to be opened to permit flow of pneumatic fluid to the tool at a predetermined operating pressure to transmit an initial pulse of pneumatic fluid to initiate operation of the hammer. The valve is kept open at a lower pressure than that required to open it. One form of the valve is a pressure operated valve, spring-loaded toward closed position, which opens at a first predetermined pneumatic pressure permitting flow to said tool and closes at a second, substantially lower, pneumatic pressure. Another form of the valve means has a valve, spring-loaded toward closed position, which opens in response to pneumatic conduit pressure, and spring loaded ball detents or a pneumatic pressure operated latch to secure the valve in an open position. The latch and valve are operated to closed position at a lower pressure.

31 Claims, 8 Drawing Sheets

EARTH BORING APPARATUS AND METHOD WITH CONTROL VALVE

BACKGROUND OF THE INVENTION

1. FIELD OF THE INVENTION

This invention relates generally to control valves for earth boring tools, and more particularly to a control valve used in the power fluid supply line of impact type earth boring tools to prevent fluid supply to the boring tool until a desired line pressure is obtained.

2. BRIEF DESCRIPTION OF THE PRIOR ART

In certain locations, such as under paved roadways, in highly developed areas or in difficult digging conditions, it may be more efficient and less expensive to bore a small diameter hole horizontally under the ground surface rather than cut a open trench to install gas, telephone, water, electric or other buried utility services. A variety of boring tools are available for this purpose, including rotary flexible rod devices, auger devices, pipe pushers, and air or hydraulic powered impact type piercing tools (also known as percussive moles), the latter being supplied power through flexible hose.

Guided boring systems have been developed to open a relatively long bore hole (several hundred or thousand feet) starting from the power unit driving the boring tool which utilize a small drilling frame or rig, sections of drill pipe or flexible hose, a down hole boring tool or "mole" with a steering assembly, and tracking instrumentation. Typically, hydraulic power is used to control various functions of the drilling frame while compressed air is furnished to the down hole boring tool by means of the drill pipe or hose and swivel devices on the drill frame carriage. The down hole boring tool may be a drilling motor driving a cutting bit to drill through rock or a percussive (impacting) mole for compacting a bore hole in soil.

As these down hole tools progress away from the drilling frame, more drill pipe is added between the boring tool and the drill frame carriage. As each joint of drill pipe is added to the drill string, air flow to the tool must be interrupted and the drill string emptied of air pressure. This is normally accomplished by a shut off or switching valve at the carriage. Once the connection of another joint of drill pipe is completed, the air flow to the down hole tool can be initiated. Thus, the drill pipe is, in effect, forming an ever increasing expansion chamber as the tool advances. A similar problem exists where the drilling mole is operated on the end of a flexible conduit or air hose which is sequentially or incrementally lengthened as the mole progresses into the ground.

Expansion of the compressed air entering the empty drill string drastically reduces the initial air pressure and energy potential available to start the tool in operation. This energy potential builds up slowly because of a limited or fixed capacity for generating compressed air entering the lengthened drill pipe. Since most air compressors have small air tanks, the time required to fill the pipe increases as the length and/or diameter of pipe increases. If pressure build-up inside the mole is slow, the pressure leaks across the hammer and the tool will not start.

The percussive tool in particular requires a certain impulse of energy to initiate operation because of hammer inertia, and internal friction and leakage. This may be further aggravated by ineffective lubrication or frost conditions from air expansion within the tool. In cold atmospheric conditions, a percussion mole may freeze moisture in the tight seal areas. For the down hole motor, similar difficulties could occur from excessive drag on the drill bit. The present invention is installed in the drill string or flexible power supply hose of pneumatic percussive moles which allows an instantaneous, high-pressure blast of air to the downstream percussion tool to overcome the problem of difficult starting conditions such as those caused by long drill strings or hose, a wet borehole or freeze-up conditions.

Several percussion mole steering systems are revealed in the prior art. Coyne et al, U.S. Pat. No. 3,525,405 discloses a steering system which uses a beveled planar anvil that can be continuously rotated or rigidly locked into a given steering orientation through a clutch assembly. Chepurnoi et al, U.S. Pat. No. 3,952,813 discloses an off-axis or eccentric hammer steering system in which the striking position of the hammer is controlled by a transmission and motor assembly. Gagen et al, U.S. Pat. No. 3,794,128 discloses a steering system employing one fixed and one rotatable tail fin. However, these patents do not suggest a control valve associated with the boring tool.

In commonly assigned U.S. Pat. Nos. 4,632,191, and 4,694,913, a steering system is disclosed for percussion boring tools for boring in the earth at an angle or in a generally horizontal direction. The steering mechanism comprises an asymmetric member attached to the anvil of the tool to produce a turning force on the tool and movable tail fins incorporated into the trailing end of the tool which are adapted to be selectively positioned relative to the body of the tool to negate the turning force. Turning force may also be imparted to the tool by an eccentric hammer which delivers an off-axis impact to the tool anvil.

There are several patents which disclose various valves having pressure operated mechanisms, none of which are used in the power fluid supply line of impact type earth boring tools, or utilize the present mechanism to prevent fluid supply to an impact type earth boring tool until a desired line pressure is obtained.

Mason, U.S. Pat. No. 3,180,433 discloses an impacting tool having a latch to prevent actuation of the tool until a predetermined velocity of the drive fluid is reached.

Jacobi, U.S. Pat. No. 2,276,979, Edman, U.S. Pat. No. 2,844,166, and Tennis, U.S. Pat. No. 2,848,014 disclose valves having pressure operated latch mechanisms, but for controlling an air-pressure-operated earth boring tool.

Articles on page 18 in the Autumn 1986 issue of MICROTUNNELING magazine (British) and on page 18 of the July 1986 issue of UNDERGROUND magazine (British) mention a percussive hammer having an electrically operated solenoid valve connected to the hammer which is manually operated when to provide the kick or boost required to get the percussive equipment moving properly.

The cited prior art and any other prior art known to applicants does not show an air operated earth boring tool having a control valve which opens automatically to permit flow of air pressure to the tool when the air-line pressure reaches a predetermined level adjacent to the tool and closes automatically at a lower pressure.

SUMMARY OF THE INVENTION

One object of this invention to provide a cost-effective, guided, horizontal boring tool which can be used to produce small diameter bore holes into which utilities, e.g., electric or telephone lines, TV cable, gas distribution piping, or the like, can be installed.

Another object of this invention is to provide a system of apparatus for earth boring including an in-line control valve used adjacent to an air-operated, earth boring tool that offers a repeatable and useful starting and operating response and which is compatible with existing boring equipment and methods.

Another object of this invention is to provide a system of apparatus for earth boring including an in-line control valve used adjacent to an air-operated, earth boring tool which will supply the tool with a high energy starting pulse of working fluid to facilitate initiation of the tool operation.

Another object of this invention is to provide a system of apparatus for earth boring including an in-line control valve used adjacent to an air-operated, earth boring tool wherein fluid is switched automatically at a pre-set pressure by fluid introduced from the opposite end of a long hollow conduit, such as a drill string composed of multiple joints of pipe or a long flexible hose.

Another object of this invention is to provide a system of apparatus for earth boring including an in-line control valve used adjacent to an air-operated, earth boring tool wherein automatic operation is accomplished by spring loaded detents or a pilot operated trip piston which unlatch the valve piston at a pre-set pressure.

Another object of this invention is to provide a system of apparatus for earth boring including an in-line control valve used adjacent to an air-operated, earth boring tool wherein the valve piston is opened and held so by the fluid pressure while supplying working fluid to operate the boring tool.

Another object of this invention is to provide a system of apparatus for earth boring including an in-line control valve used adjacent to an air-operated, earth boring tool which will automatically close after fluid flow to the valve has been interrupted by an upstream valve, thereby positioning the valve for another high energy pulse to restart the boring tool.

Another object of this invention is to provide a system of apparatus for earth boring including an in-line control valve used adjacent to an air-operated, earth boring tool in which the valve body is in the form of a sub which may be placed within a pipe string at any desired point and is not restricted as to the size or design of the tool joint being used and is applicable to a wide range of drill pipe.

Another object of this invention is to provide a system of apparatus for earth boring including an in-line control valve used adjacent to an air-operated, earth boring tool in which the valve body is in the form of a sub which may be placed within a pipe string at an desired point and has a latching feature which will allow filling the fluid power supply hose or drill string to a pre-set pressure before the boring tool is supplied with compressed air.

Another object of this invention is to provide a system of apparatus for earth boring including an in-line control valve used adjacent to an air-operated, earth boring tool in which the valve body is in the form of a cartridge which may be installed inside the drill string at the threaded connection of two joints of drill pipe and may be quickly replaced by simply exchanging cartridges.

A further object of this invention is to provide a system of apparatus for earth boring including an in-line control valve used adjacent to an air-operated, earth boring tool utilizing flexible hose as the power supply conduit in which the valve body has hose connection fittings at each end.

A still further object of this invention is to provide a system of apparatus for earth boring including an in-line control valve used adjacent to an air-operated, earth boring tool which is simple in design, economical to manufacture, and rugged and durable in use.

Another object of this invention is to provide an improved in-line control valve for use adjacent to an air-operated, earth boring tools that offers a repeatable and useful starting and operating response and which is compatible with existing boring equipment and methods.

Another object of this invention is to provide an improved in-line control valve for use adjacent to an air-operated, earth boring tool which will supply the tool with a high energy starting pulse of working fluid to facilitate initiation of the tool operation.

Another object of this invention is to provide an improved in-line control valve for use adjacent to an air-operated, earth boring tool wherein fluid is switched automatically at a pre-set pressure by fluid introduced from the opposite end of a long hollow conduit, such as a drill string composed of multiple joints of pipe or a long flexible hose.

Another object of this invention is to provide an improved in-line control valve for use adjacent to an air-operated, earth boring tool wherein automatic operation is accomplished by spring loaded ball detents or a pilot operated trip piston which unlatches the valve piston at a pre-set pressure.

Another object of this invention is to provide an improved in-line control valve for use adjacent to an air-operated, earth boring tool wherein the valve piston is opened and held so by the fluid pressure while supplying working fluid to operate the boring tool.

Another object of this invention is to provide an improved in-line control valve for use adjacent to an air-operated, earth boring tool which will automatically close after fluid flow to the valve has been interrupted by an upstream valve, thereby positioning the valve for another high energy pulse to restart the boring tool.

Another object of this invention is to provide an improved in-line control valve for use adjacent to an air-operated, earth boring tool in which the valve body is in the form of a sub which may be placed within a pipe string at any desired point and is not restricted as to the size or design of the tool joint being used and is applicable to a wide range of drill pipe.

Another object of this invention is to provide an improved in-line control valve for use adjacent to an air-operated, earth boring tool in which the valve body is in the form of a sub which may be placed within a pipe string at any desired point and has a latching feature which will allow filling the fluid power supply hose or drill string to a preset pressure before the boring tool is supplied with compressed air.

Another object of this invention is to provide an improved in-line control valve for use adjacent to an air-operated, earth boring tool in which the valve body is in the form of a cartridge which may be installed inside the drill string at the threaded connection of two joints of drill pipe and may be quickly replaced by simply exchanging cartridges.

A further object of this invention is to provide an improved in-line control valve for use adjacent to an air-operated, earth boring tool utilizing flexible hose as the power supply conduit in which the valve body has hose connection fittings at each end.

A still further object of this invention is to provide an improved in-line control valve for use adjacent to an air-operated, earth boring tool which is simple in design, economical to manufacture, and rugged and durable in use.

Other objects of the invention will become apparent from time to time throughout the specification and claims as hereinafter related.

The above noted objects and other objects of the invention are accomplished by a system of apparatus comprising an air operated earth boring tool having a new and improved control valve which substantially prevents flow of air pressure to the tool until the air-line pressure reaches a predetermined level adjacent to the tool.

DESCRIPTION OF THE PREFERRED EMBODIMENT

Figure 1:
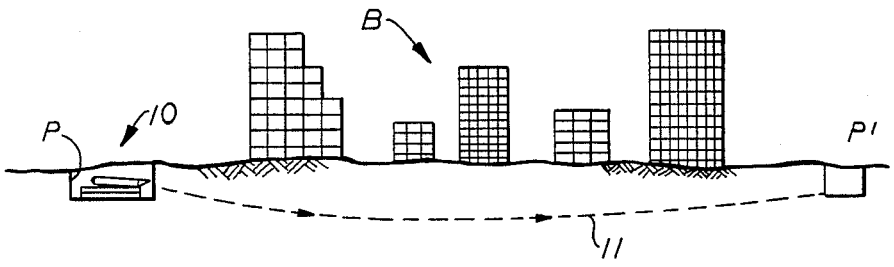
FIG. 1 is a schematic drawing, partially in section, showing horizontal boring from a recessed pit containing a drilling rig.
Figure 2:
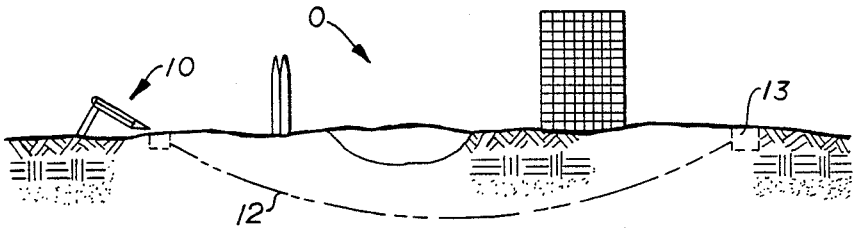
FIG. 2 is a schematic drawing, partially in section, showing horizontal boring from a drilling rig on the surface.

Referring to the drawings by numerals of reference, and more particularly to FIGS. 1 and 2, there are shown schematic views, in vertical section, of two systems for boring long horizontal utility holes.

In FIG. 1, there is shown a schematic view of long horizontal boring starting from a launching pit and utilizing sections or joints of drill pipe. In FIG. 1, there is shown a launching pit P in which there is positioned a drilling rig and boring apparatus generally designated 10 for boring a horizontal hole along the drill line 11 to an exit pit P'. Bore hole 11 is shown extending beneath a plurality of buildings B.

In FIG. 2 there is shown an alternate version of horizontal boring which uses a slant drilling technique. In FIG. 2, drill rig 10 is mounted at an angle to the earth so that the boring enters the earth at an angle continues along an arcuate path 12 where it exits from the earth at exit point 13 beyond the obstacles under which the hole has been drilled. In FIG. 2, bore hole 12 passes beneath obstacles generally designated O, such as a windmill, a lake or river and/or a building. In both versions, the utility pipe or conduit laid in the holes which are bored will connect to trenches for continuing the utility lines beyond the obstacles where trenching may be the more economical way to lay pipe or conduit.

Figure 3:
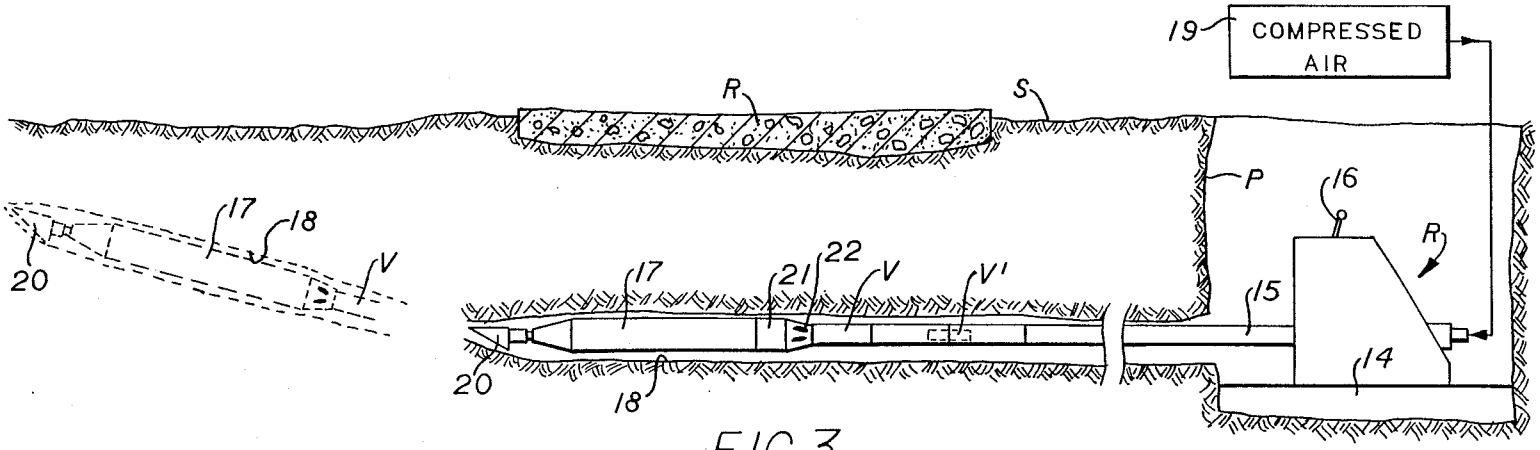
FIG. 3 is a schematic drawing, partially in section, showing horizontal boring from a recessed pit containing a drilling rig, using a drilling mole mounted on a hollow drill pipe driven by the rig.

In FIG. 3, there is shown a launching pit P recessed from the surface S of the earth on one side of an obstacle such as a road bed R under which the utility hole is to be bored. Drill rig R1 is shown schematically in the launching pit P supported on tracks 14. Rig R1 is of a construction similar to vertically operated drilling rigs but utilizes movement along tracks 14 to provide the drilling thrust.

Drilling rig R1 is operable to support and move sections of drill pipe 15 and permits the addition of additional sections of pipe as the drilling progresses through the earth. Drilling rig R has conventional controls illustrated by control handle 16 on the drill console. Drill pipe 15 supports a drilling mole 17 at its end for drilling a horizontal hole 18 through the earth. Drilling mole 17 is a pneumatically operated drilling mole and may have the structure shown in U.S. Pat. No. 4,632,191 or 4,694,913.

Drill pipe 15 is hollow and connected to the source 19 of compressed air. Compressed air from compressed air source 19 is supplied through hollow drill pipe 15 to pneumatic mole 17 which operates a hammer (not shown) which pounds on an anvil member connected to an external boring element 20. In one embodiment, a "tool joint" control valve V is installed rearwardly of the mole 17 between two joints of the drill pipe. The "tool joint" valve V utilizes a sub as part of the valve assembly and may be placed within the drill string at any desired point. As represented in dotted line, a modified control valve or "cartridge" valve V' may be installed inside the drill pipe at the threaded connection of two joints of drill pipe. Cartridge valve V' eliminates the need for a sub with tool joints since the cartridge can be retro-fitted into a tool joint of the drill pipe. The cartridge valve V' allows a quick change of the valve assembly by simply exchanging cartridges. The control valves will be shown and described in detail hereinafter.

Drilling mole 17 may have a sub 21 connecting the mole to the hollow drill pipe 15 of the type shown in U.S. Pat. No. 4,694,913 or of other suitable construction providing for introduction and exhausting of air. The particular sub used is not critical to the invention and the one shown is for illustration only. Connection sub 21 is shown in detail in FIG. 6 and has a plurality of holes or openings for exhausting air from mole 17 back into bore hole 18 behind the mole.

The asymmetric structure of boring element 20 causes the boring mole to deviate from a straight path and to follow a continually curving path. This permits the use of a tool for drilling slant holes along an arcuate path as shown in FIG. 2. It also permits the tool to be used where a straight hole needs to be drilled and at some point into the hole the mole is allowed to deviate along a selected curved path to emerge from underground through the surface of the earth.

Drilling rig R1 has a mechanism for not only advancing the supporting pipe 15 and drilling mole 17 but also to rotate the pipe and drilling mole. If drilling rig R1 causes pipe 15 and drilling mole 17 to rotate, the angled boring surface of boring element 20 is rotated and the tool is allowed to move in a straight line. Actually the tool does not move in a perfectly straight line but rather in a very tight spiral which is substantially a straight line.

Other known means for deflecting a drill bit or other earth boring member may be used, such as; an asymmetric hammer in the boring tool, deflection pads on an in-hole hammer, or a bent sub supporting a in-hole hammer. Also, in cases where straight hole drilling is not required, i.e., where it is desired only to drill in a curved boring path, the means for rotating the hammer or the boring or piercing member may be omitted.

Figure 4:
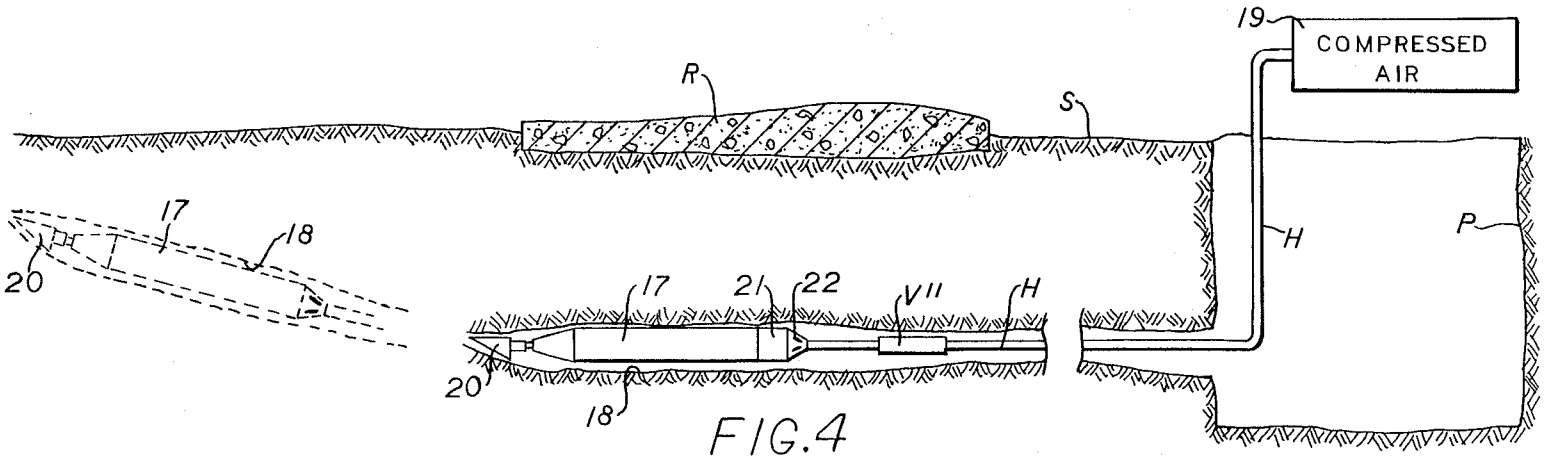
FIG. 4 is a schematic drawing, partially in section, showing horizontal boring from a recessed pit, using a boring member mounted on a flexible fluid power supply hose.

FIG. 4 shows another installation in which mole 17 is mounted on the end of a flexible fluid power supply line which is driven from launching pit P. In this installation, the drill rig is eliminated. Compressed air from compressed air source 19 is supplied through flexible hose H to pneumatic mole 17. A "connector" control valve V' having hose fittings at each end is installed rearwardly of mole 17 in the hose line.

Figure 5:
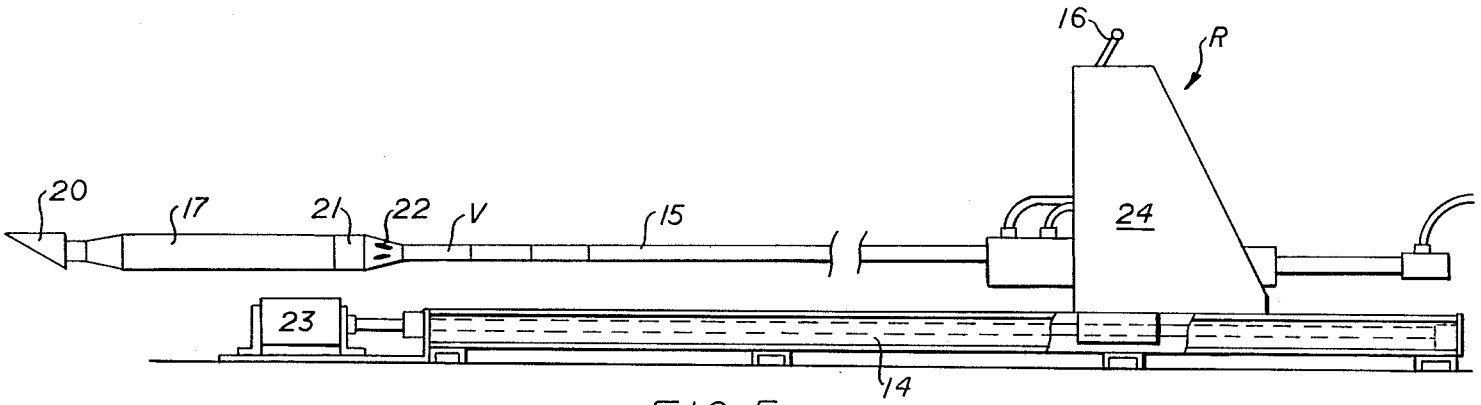
FIG. 5 is a more detailed schematic of the drill rig and drilling shown in FIG. 3.

In FIG. 5 there are shown some additional details of the earth boring apparatus. In this view it is seen that drill rig R is mounted on track 14 and is provided with a motor 23 or other means such as hydraulic cylinders for advancing the console 24 of the rig along the track and also has a motor for rotating the hollow drill pipe 15. Console 24 has control handles 16 which determine the advance of the console along track 14 and also may selectively rotate the drill pipe 15 or permit the drill pipe to remain in a non-rotating position. Drill rig R1 utilizes conventional features of drill rig design for surface rigs which permits the addition of successive sections on drill pipe 15 as drilling mole 17 is moved through the earth.

Figure 6:
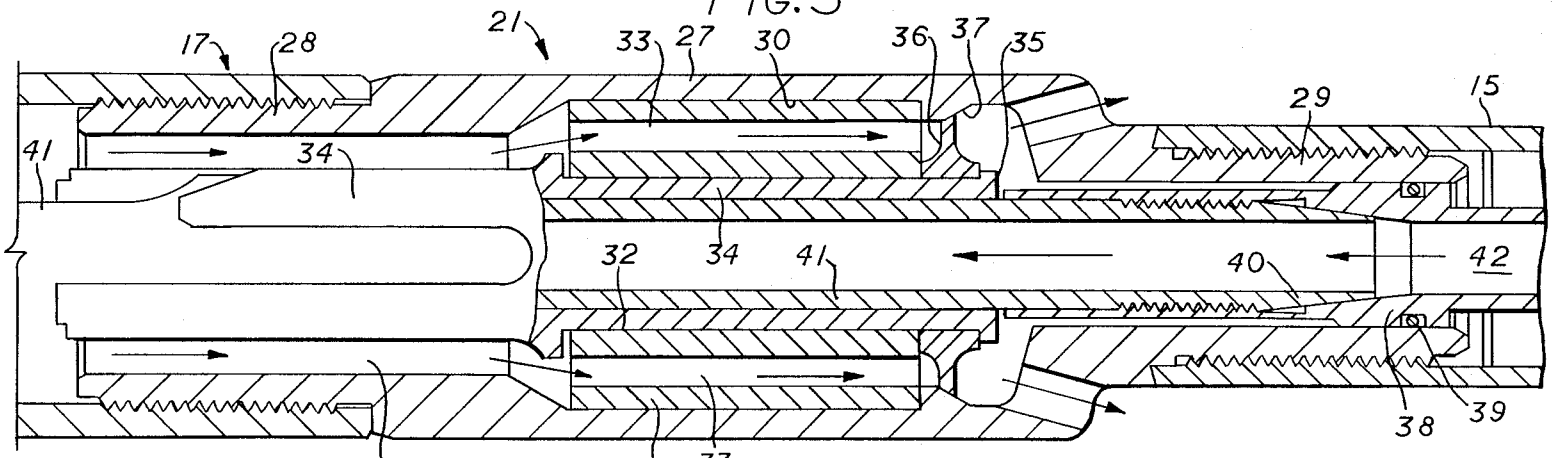
FIG. 6 is a sectional view of the connection sub for mounting the boring mole on the hollow drill pipe to provide for exhausting air from the mole.

In FIG. 6 there are shown details of one form of connecting sub 21 which connects the housing of drilling mole 17 to hollow drill pipe 15. The particular sub used is not critical to the invention and the one shown is for illustration only. Connecting sub 21 comprises a main tubular body portion 27 having smaller tubular extensions 8 and 29 at opposite ends. Extensions 28 and 2 fit respectively into the open rear end of the housing of drilling mole 17 and the forward end of drill pipe 15. It should be understood that extension 29 may be adapted to fit the forward end of a flexible hose or that an adapter may be installed therebetween for such purpose (not shown).

The main body portion 17 has an enlarged bore 30 which receives a cylindrical supporting member 31 having a central bore 32 and a plurality of air passages 33. Supporting member 31 supports tubular member 34 in central bore 32. Tubular member 34 terminates in a flanged end portion 35 supporting annular check valve 36 which is normally closed against valve surface 37. Another tubular member 38 is supported in tubular extension 29 and sealed against leakage of air pressure by O-ring 39.

Tubular member 38 receives the reduced diameter end portion 40 of a tubular member 41 extending into the housing of mole 17 for conducting air into the mole for operating the hammer. This connection sub conducts compressed air from drill pipe 15 or hose H through the inlet 42 to tubular member 38 and through the hollow bore 43 of tubular member 41 provides a percussive force to the boring element 20. The spent air from operating the hammer passes from the housing of mole 17 through passage 44 and passages 33 and supporting member 31, passed check valve 36 and out through exhaust ports or passages 21.

Figure 7A:
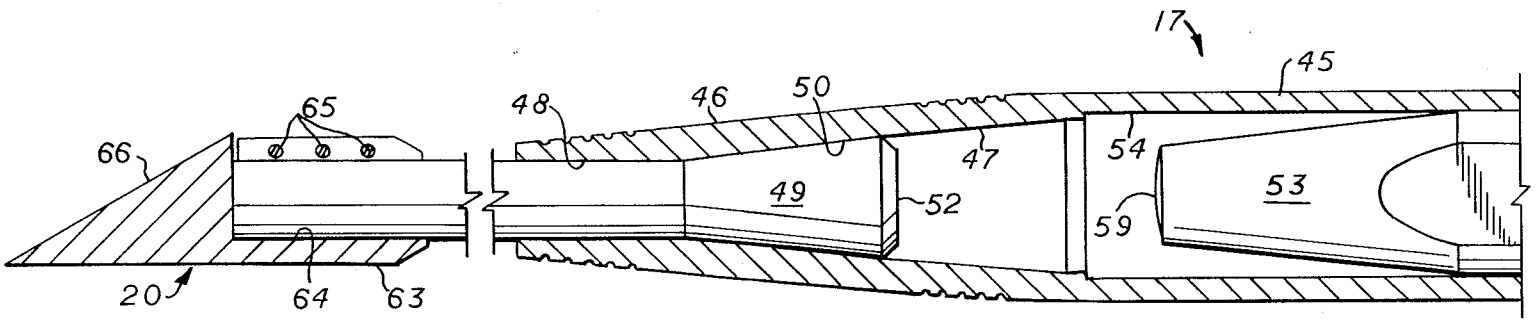
FIGS. 7A and 7B longitudinal sections of the front and rear portions of the drilling mole.
Figure 7B:
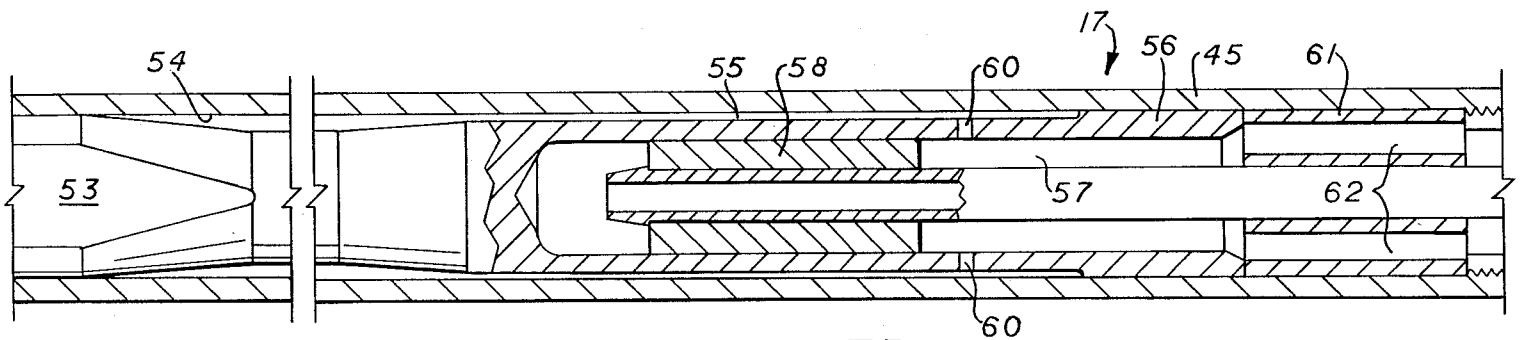

FIGS. 7A and 7B are longitudinal sections on boring mole 17 shown in FIGS. 3–5, substantially as shown in U.S. Pat. Nos. 4,632,191, and 4,694,913. As shown, boring mole 17 comprises a hollow cylindrical outer housing or body 45. The outer front end of body 45 tapers inwardly forming a conical portion 46. Inner diameter of body 45 tapers inwardly near the front end forming a conical surface 47 which terminates in a reduced diameter 48 extending longitudinally inward from the front end. The rear end of body 45 has internal threads for receiving connection sub 21.

An anvil 49 having a conical back portion 50 and an elongated cylindrical front portion 51 is positioned in the front end of body 45. Conical back portion 50 of anvil 49 forms an interference fit on conical surface 47 of body 45, and the elongated cylindrical portion 51 extends outwardly a predetermined distance beyond the front end of the body. A flat transverse surface 52 at the back end of anvil 49 receives the impact of a reciprocating hammer 53. It is also possible to use the front end of the body as an anvil without having a separate anvil member, in which case, the steering and boring piece is removable connected to the outside of the body housing.

Reciprocating hammer 53 is an elongated cylindrical member slidably received within cylindrical recess 54 of body 45. A substantial portion of the outer diameter of hammer 45 is smaller in diameter than recess 54 in body 45, forming an annular cavity 55. A relatively shorter portion 56 at the back end of hammer 53 is of a diameter providing a sliding fit against the interior wall of recess 54 of body 45.

Central cavity 57 extends longitudinally inward from the back end of hammer 53. Cylindrical bushing 58 is slidably disposed within hammer cavity 57. Front surface 59 of hammer 53 is shaped to provide an impact centrally on flat surface 52 of anvil 49. It should be understood that the hammer configuration may also be adapted to deliver an eccentric impact force on the anvil.

Air passages 60 in the side wall of hammer 53 inwardly adjacent the shorter rear portion 56 connect central cavity 57 with annular cavity 55. Air distribution tube 41 extends centrally through bushing 58 and has its back end connected through connection sub 21 to supporting pipe 15 providing a passageway for introduction of air to the tool from the pipe. For reciprocating hammer 53, air distribution tube 41 is in permanent communication with a compressed air source through passages 60 and bushing 58 is such that, during reciprocation of hammer 53, air distribution tube 41 alternately connects annular cavity 55 with the central cavity 57 or atmosphere.

A cylindrical stop member 61 (part of connecting sub 21) is secured within recess 54 of body 45 near the back end and has a series of longitudinally-extending, circumferentially-spaced passageways 62 for exhausting the interior of body 28 to atmosphere and a central passage through which the air distribution tube 41 extends.

Slant-end nose member 20 (other asymmetric nose members or their equivalent may be used) has cylindrically recessed portion 63 with a central cylindrical bore 64 therein received on the cylindrical portion 51 of anvil 49 (FIG. 7A). The nose member 20 is secured to the end of the anvil member 51 by suitable means such as clamping it on with screws 65.

The side wall of nose member 20 extends forward from cylindrical portion 63 and one side is milled to form a flat inclined surface 66 which tapers to a point at the extended end. The length and degree of inclination may vary depending upon the particular application.

Figure 8A:
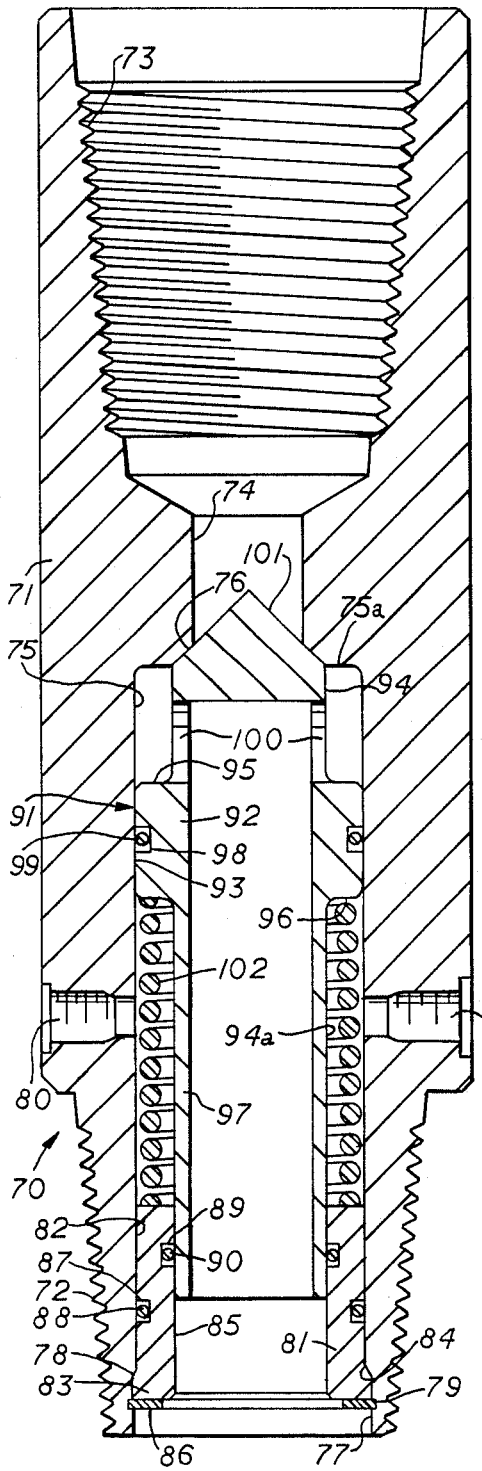
FIGS. 8A and 8B are longitudinal sections in the closed and open positions respectively of an embodiment of the control valve of the present invention which may be installed in the drill pipe string at any desired point.
Figure 8B:
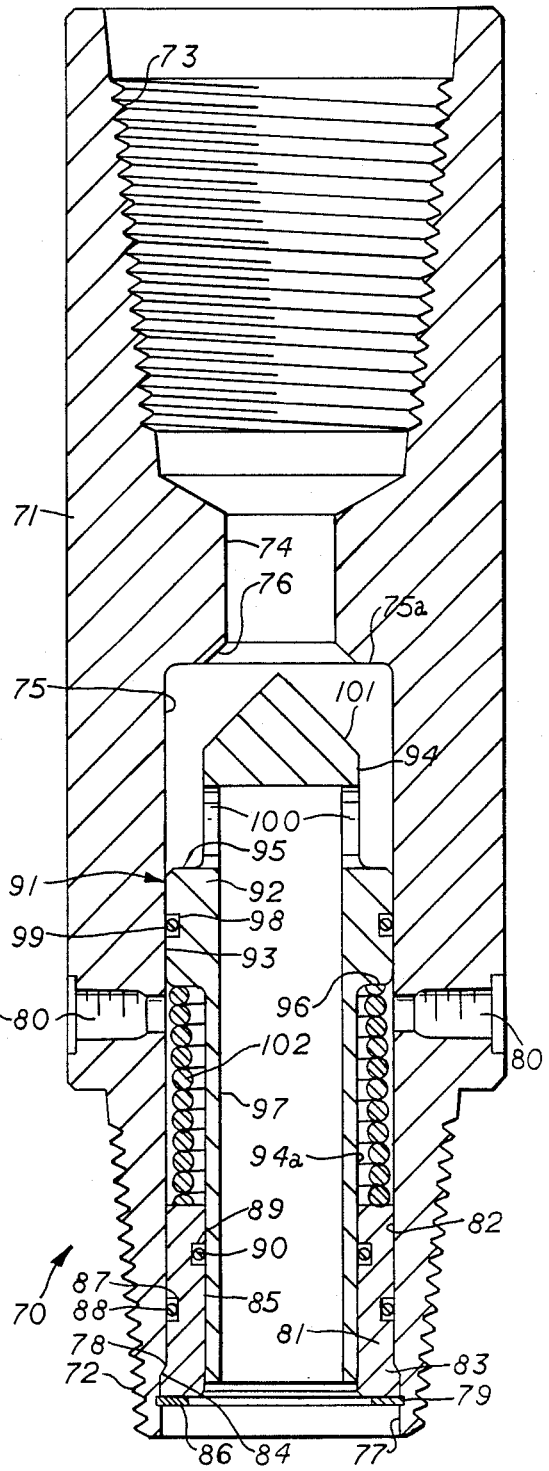

There are several forms of the downhole control valve which are used in cooperation with the above described boring tool, or other pneumatic boring tools. The control valve is positioned in the drill string or in the flexible air-hose or conduit generally adjacent to the earth boring tool to control the introduction of air into the tool and prevent tool operation until the air line pressure has reached a predetermined level, remain open at a lower level of pressure, and close when the pressure is substantially turned off. Referring now to FIGS. 8A and 8B, a "tool joint" control valve 70 is shown in the closed (FIG. 8A) and open (FIG. 8B) positions respectively.

The "tool joint" valve assembly 70 comprises a cylindrical housing or valve body 71 having external male threads 72 on one end and female threads 73 on the opposed end and a smaller central longitudinal bore 74. An enlarged smooth bore 75 extends inwardly from the male threaded end of the body to define a flat shoulder **75*a* between the bores 74 and 75. A conical taper at the juncture of bore 74 with the flat shoulder forms a valve seat surface 76. The lower portion of the enlarged bore 75 is counterbored at 77 to define a shoulder 78. A snap ring groove 79 is provided in the side wall of counterbore 77 between the end of the body and the conical shoulder 78. Relief ports 80 extend through the side wall of the body 71 to communicate the enlarged bore 75** with atmosphere.

A cylindrical spring retainer and valve guide 81 has a first exterior diameter 82 and an enlarged diameter 83 at one end defining a shoulder 84 therebetween and central longitudinal smooth bore 85. Guide member 81 has a sliding fit inside the enlarged bore 75 and counterbore 77 of the body with shoulder 78 abutting shoulder 84, and is releasably secured therein by means of snap ring 86. An annular groove 87 and O-ring seal 88 are provided on the first exterior diameter 82 forming a seal between bore 75 and guide member 81. An annular groove 89 and O-ring seal 90 on inner bore 85 seal a guide extension on a piston valve member as described below.

A piston valve member 91 is positioned for sliding movement in the enlarged smooth bore 75. Piston valve member 91 comprises a hollow tubular body 92 enclosed at one end and having a larger exterior diameter 93 and reduced diameters 94 and **94*a* at opposite ends thereof defining flat upper shoulder 95 and lower shoulder 96. A central longitudinal bore 97 extends inwardly from the open end and terminates at the closed end thereof. Reduced diameter 94*a* forms a valve guide extension having a sliding fit in bore 85 of guide member 81 for reciprocal guiding movement with O-ring 90** forming a seal therebetween.

The larger diameter 93 of the piston body 92 has a sliding fit in enlarged bore 75 of the valve body 71 for reciprocal movement therein. An annular groove 98 and O-ring seal 99 on the larger diameter 93 forms a seal between the smooth enlarged bore 75 and the exterior of the piston body. Apertures 100 through the side wall of the piston body 92 communicate the interior of the piston with the valve body bore 75. The end of the piston is a conical valve 101 fitting against conical valve seat surface 76 in the closed position as shown in FIG. 8A.

A coiled spring 102 surrounds the reduced diameter **94*a* of the piston body 92 and is compressed between the top end of guide member 81 and piston valve shoulder 96 to normally urge the conical valve 101 to closed position against the conical valve seat surface 76** of the valve body.

Because the valve body of this embodiment is essentially a sub, it may be placed within a drill string at any desired point. This embodiment is not restricted as to the size or design of the tool joint being used and is applicable to a wide range of drill pipe.

Figure 9A:
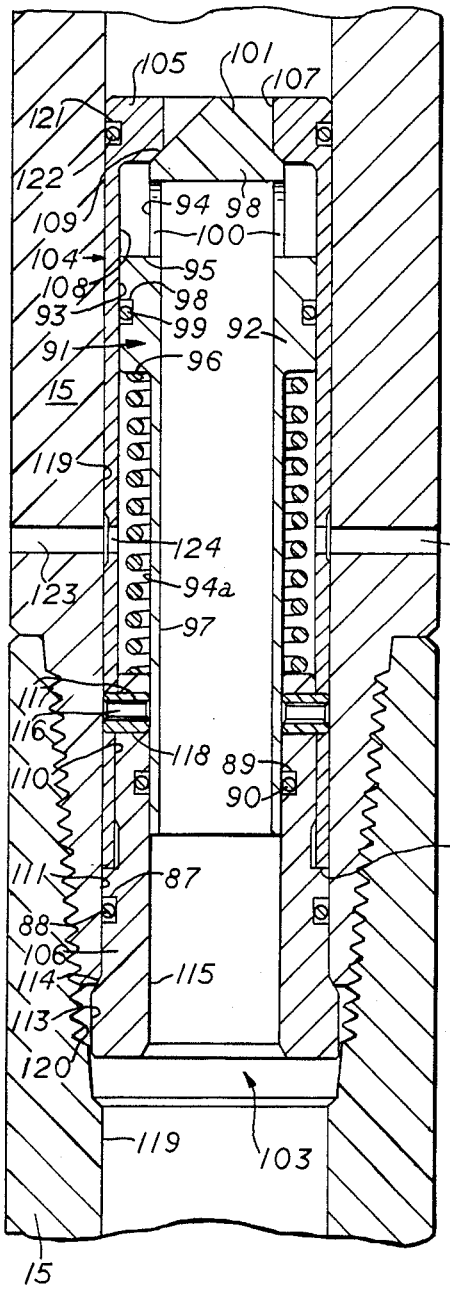
FIGS. 9A and 9B are longitudinal sections in the closed and open positions respectively of a modification of the embodiment of the control valve of FIGS. 8A and 8B which may be installed inside a drill pipe connection.
Figure 9B:
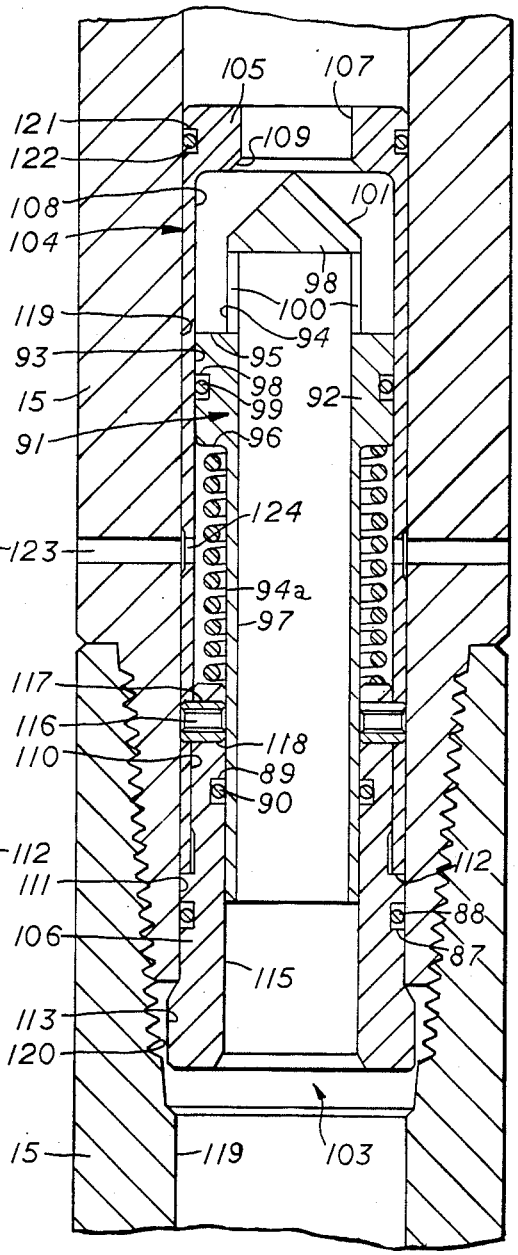

In FIGS. 9A and 9B, another embodiment of the control valve, referred to as the "cartridge" control valve is shown in the closed and open positions respectively. Some of the components of the "cartridge" valve are the same as those previously described and will be assigned the same numerals of reference. The previously described "tool joint" embodiment utilizes the sub as part of the valve assembly where as the "cartridge" type is a removable valve assembly which is placed in a bore within the drill pipe at the threaded connection.

The "cartridge" valve assembly 103 comprises a housing having hollow cylindrical upper portion 104 with an end wall 105 and a cylindrical guide sleeve 106 fitted in the opposed end. A central bore 107 extends through the top wall 105 and forms a valve port. An enlarged smooth bore 108 extends inwardly a distance from the open end of the upper member 104 to define a shoulder **105*a* between bores 107 and 108. A conical transition at the junction of bore 107 and the shoulder forms a valve seat 109**.

The exterior of the cylindrical guide sleeve 106 has first diameter 110, second intermediate diameter 111 large than the first defining a flat shoulder 112 therebetween, and third diameter 113 larger than the second defining shoulder 114 therebetween. A central longitudinal smooth bore 115 extends through sleeve 106. First diameter 110 is slidably received in enlarged bore 108 of the upper member 104. The second diameter 111 is substantially the same diameter as the outside diameter of upper member 104 and shoulder 112 forms a stop against the open end of the upper member. Hollow removable dowel pins 116 in holes 117 in the side wall of the upper member 104 and aligned holes 118 in the sleeve side wall releasably secure upper member 104 and sleeve 106 together.

The second diameter 111 of sleeve 106 and the exterior diameter of the upper member 104 are both slightly smaller than the bore 119 of a standard tool joint 15 to be slidably received therein. The third diameter 113 of sleeve 104 is larger than the bore 119 of the tool joint and the shoulder 114 serves as a stop against the open male end of the standard tool joint. The "cartridge" or assembled sleeve 106 and upper member 104 fit inside the tool joint bore 119 and the third diameter 113 of the sleeve extends a short distance beyond the male end of the tool joint 15. The sleeve diameter 113 is slightly less than the diameter of the thread run-out of the female threads 120 of the tool joint into which the tool joint containing the cartridge valve is threaded. In this manner, the "cartridge" control valve embodiment is secured in the drill pipe at the threaded connection.

A first seal comprising annular groove 121 and O-ring seal 122 on the exterior diameter of the upper member 104 and a second seal comprising annular groove 87 and O-ring seal 88 on the second diameter 111 of sleeve 106 form upper and lower fluid seals between the tool joint bore 119 and the exterior of the cartridge assembly A third seal comprising annular groove 89 and O-ring seal 90 on the longitudinal bore 115 of the sleeve 106 seal against bore 119 of tool joint 15. Axially aligned relief ports 123 and 124 extend through the side wall of the tool joint 15 and the upper member 104 respectively to communicate the upper member bore 108 with atmosphere at a point intermediate the seals 88 and 99.

A piston valve member 91 is positioned for sliding movement in the enlarged smooth bore 109. Piston valve member 91 comprises a hollow tubular body 92 closed at one end and having a larger exterior diameter 93 and reduced diameters 94 and **94*a* at opposite ends thereof defining a flat upper shoulder 95 and lower shoulder 96. A central longitudinal bore 97 extends inwardly from the open end and terminates at the closed end 98. Reduced diameter 94*a* forms a valve guide extension having a sliding fit in bore 115 of sleeve 106 for reciprocal guiding movement with O-ring 90** forming a seal therebetween.

The larger diameter 93 of the piston body 92 has a sliding fit in enlarged bore 108 of the valve body 104 for reciprocal movement therein. An annular groove 98 and O-ring seal 99 on the larger diameter 93 forms a seal between the smooth enlarged bore 108 and the exterior of the piston body. Apertures 100 through the side wall of the piston body 92 communicate the interior of the piston with the valve body bore 108. The end of the piston is a conical valve 101 fitting against conical valve seat surface 76 in the closed position as shown in FIG. 9A.

A coiled spring 102 surrounds the reduced diameter **94*a* of the piston body 92 and is compressed between the top end of guide sleeve 106 and piston valve shoulder 96 to normally urge the conical valve 101 to closed position against the conical valve seat surface 109 of valve body 104**.

The "cartridge" control valve embodiment eliminates the need for a sub with tool joints since the cartridge can be retro-fitted into a tool joint of the drill pipe. The cartridge model allows a quick change of the valve assembly by simply exchanging cartridges.

Figure 10A:
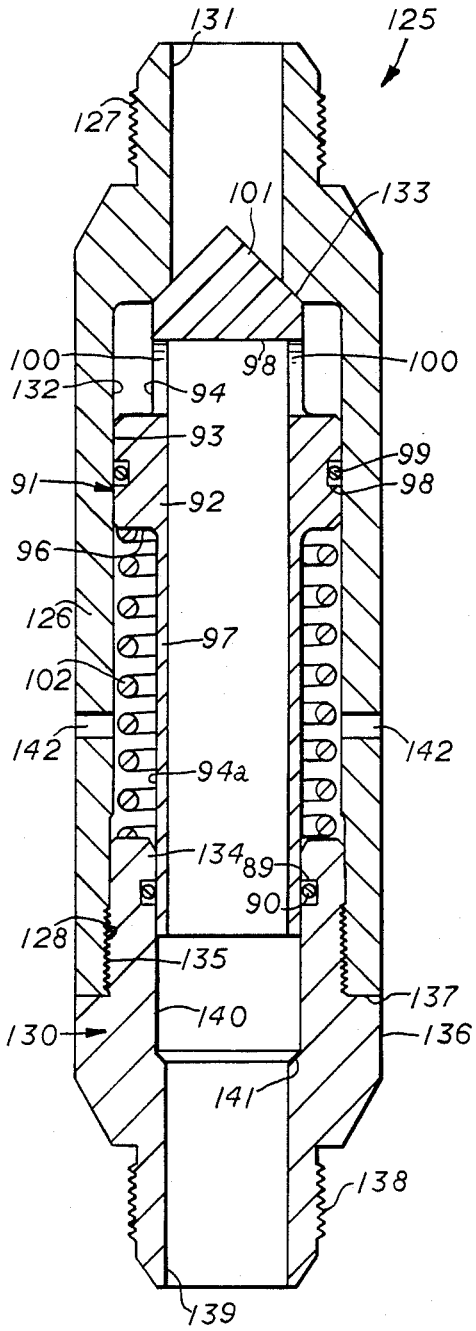
FIGS. 10A and 10B are longitudinal sections in the closed and open positions respectively of another modification of the control valve which may be installed in a flexible hose fluid power supply line.
Figure 10B:
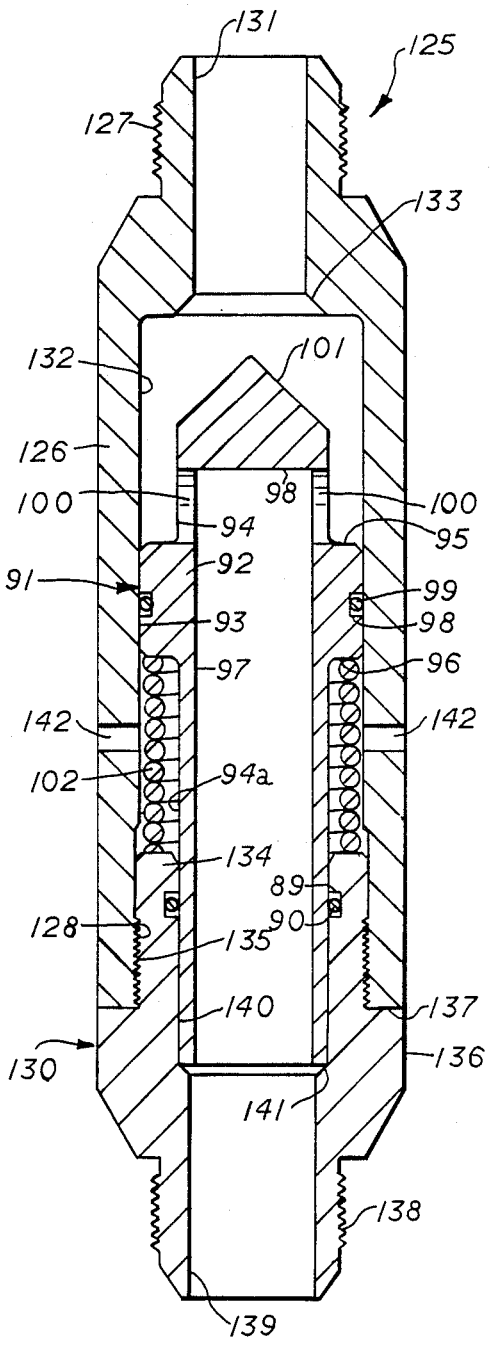

As shown in FIGS. 10A and 10B, another embodiment of the control valve is designed to be used with flexible air hose tools, hereinafter referred to as the "connector" control valve. Once again, the basic internal features are essentially the same, the difference being a smaller outside diameter and hose adaptable fittings in place of the tool joints. Components of the "connector" valve which are the same as those previously described will be assigned the same numerals of reference.

The "connector" valve assembly 125 comprises a valve housing with a hollow cylindrical upper portion 126 externally threaded at one end with male hose connector threads 127 and female threads 128 on the opposed end which threadedly receive a cylindrical lower portion or guide sleeve 130. A longitudinal bore 131 extends through the externally threaded end 127 and an enlarged smooth bore 132 extends inwardly a distance from the female threaded end 128 of the upper member 126 to define a shoulder **131*a* between bores 131 and 132. A conical transition at the junction of bore 131 and shoulder 131*a* forms a valve seat 133**.

Guide sleeve 130 portion of the valve housing has an end portion 134 externally threaded at 135 to engage the upper member threads 128, and second portion 136 larger than the first defining a flat shoulder 137 therebetween. The other end of guide sleeve 130 has a reduced diameter portion externally threaded with male hose connector threads 138. A central longitudinal smooth bore 139 extends through one end of the sleeve 130 and an enlarged bore 140 extends inwardly from opposite end to define a shoulder 141 therebetween.

The end portion 134 of the sleeve 130 is slidably received in the enlarged bore 132 of the upper housing portion 126 when the threads 128 and 135 are engaged and the flat shoulder 137 serves as a stop against the open end of the upper housing portion 126. Thus, the upper member 126 and the adapter sleeve 130 are threadedly and releasably secured together. An annular groove 89 and O-ring seal 90 on bore 140 of guide sleeve 130 seals the piston valve as described below. Relief ports 142 extend through the side wall of the upper housing portion 126 to communicate with atmosphere.

A piston valve member 91 is positioned for sliding movement in the enlarged smooth bore 132 of upper housing portion 126. Piston valve member 91 comprises a hollow tubular body 92 closed at one end and having a larger exterior diameter 93 and reduced diameters 94 and **94*a* at opposite ends thereof defining a flat upper shoulder 95 and lower shoulder 96. A central longitudinal bore 97 extends inwardly from the open end and terminates at the closed end 98. Reduced diameter 94*a* forms a valve guide extension having a sliding fit in bore 140 of sleeve 130 for reciprocal guiding movement with O-ring 90** forming a seal therebetween.

The larger diameter 93 of the piston body 92 has a sliding fit in enlarged bore 132 of the valve body member 126 for reciprocal movement therein. An annular groove 98 and O-ring seal 99 on the larger diameter 93 forms a seal between the smooth enlarged bore 132 and the exterior of the piston body. Apertures 100 through the side wall of the piston body 92 communicate the interior of the piston with the valve body bore 132. The end of the piston is a conical valve 101 fitting against conical valve seat surface 133 in the closed position as shown in FIG. 10A.

A coiled spring 102 surrounds the reduced diameter 94a of the piston body 92 and is compressed between the top end of guide sleeve 130 and piston valve shoulder 96 to normally urge the conical valve 101 to closed position against the conical valve seat surface 133 of valve body member 126.

OPERATION

Under action of compressed air from the source shown schematically as 19, the hammer in the drilling mole moves toward the front of the body of the mole and impacts on the interior surface of the drilling anvil. Details of this structure can be found in U.S. Pat. Nos. 4,632,191 and 4,694,913.

In this position, compressed air is admitted through the through the control valve V and connection sub 21 into the interior of the mole first to move the hammer to impact on the anvil and then to move the hammer away from the anvil. The repeated action of the hammer on the anvil causes a percussive impact to be imparted to boring element 20 which pierces the earth without producing cuttings or spoils. The inclined face of boring element 20 is operable to cause the tool to deviate from a straight path.

As the boring tool progresses away from the drilling frame, more drill pipe is added between the boring tool and the drill frame carriage. As each joint of drill pipe is added to the drill string, air flow to the tool must be interrupted and the drill string emptied of air pressure. This is normally accomplished by a shut off or switching valve at the carriage. Once the connection of another joint of drill pipe is completed, the air flow to the down hole tool can be initiated. Thus, the drill pipe is, in effect, forming an ever increasing expansion chamber as the tool advances.

Expansion of the compressed air entering the empty drill string drastically reduces the initial air pressure and energy potential available to start the tool in operation. This energy potential builds up slowly because of a limited or fixed capacity for generating compressed air entering the lengthened drill pipe. Since most air compressors have small air tanks, the time required to fill the pipe increases as the length and/or diameter of pipe increases. If pressure build-up inside the mole is slow, the pressure leaks across the hammer and the tool will not start.

The percussive tool in particular requires a certain impulse of energy to initiate operation because of hammer inertia, and internal friction and leakage. This may be further aggravated by ineffective lubrication or frost conditions from air expansion within the tool. In cold atmospheric conditions, a percussion mole may freeze moisture in the tight seal areas. For the down hole motor, similar difficulties could occur from excessive drag on the drill bit.

The control valve of this invention is installed upstream of the boring tool, and generally adjacent thereto, in the drill string or on the flexible power supply hose of pneumatic percussive moles and allows the pressure to build-up before reaching the tool. At a predetermined pressure, the valve opens and allows air at operating pressure to immediately blast the hammer. This prevents the pressure from equalizing across the hammer and allows the tool to start.

In cold atmospheric conditions, a percussion mole may freeze moisture in the tight seal areas. A high-pressure blast provided by the control valve will help break-up and remove the frozen moisture and allow the tool to operate. This technique also applies to borehole water that has entered the mole. The valve provides an air blast which forces most of the water out and allows the tool to start.

The forms of the downhole valve previously described in detail utilize the same basic components and operate in similar fashion. The embodiments of FIGS. 8–10 have basically one moving part, the piston valve. The following description is with reference to FIGS. 8 and 8A but is applicable to the valves of FIGS. 9 and 10, as well.

The control valve 70 is installed in the drill string or supply hose with the conical valve 101 facing upstream away from the boring tool toward the fluid power source. The valve 70 is initially closed, at low or no pressure, and is subjected to line pressure as the air pressure is turned on. When the line pressure reached a predetermined level the valve is opened by moving the valve piston 91 against the closing force of the coil spring 102 normally closing the valve.

When the valve 101 is opened, the air flows through the open valve port 74 and the apertures 100 in the piston valve member 91 and on to the boring tool. In the valve open position, the air pressure acting on the enlarged diameter portion, i.e. shoulder 95, of the valve piston 91 provides sufficient pressure differential relative to bore hole pressure to which it is exposed through the vent holes 80 in the valve body will hold the valve in the open position. The dual seal design, i.e. upper and lower seals 99 and 88, requires a relatively large opening pressure but, due to a seal area increase, requires a lower pressure to remain open. This compensates for unintentional pressure reductions in the supply line and allows the tool to keep running. The valve will not close if the pressure should drop below the opening pressure. The valve closes when the force applied to shoulder 95 relative the bore hole pressure is less than the strength of coil spring 102.

The valve is adjustable with respect to opening pressure. The opening pressure is altered by changing the coil spring 102. A higher opening pressure would require a stiffer spring, likewise a lower opening pressure would utilize a softer spring. The valve is also designed to minimize pressure drop and reductions in flow rate. This is accomplished by taking the pressure drop that opens the valve across the valve seat, while taking the pressure drop that holds the valve open from the bore of the valve to the hole annulus 100, instead of across the seal seat. This not only maintains working pressure for the tool but also maintains the flow rate.

The valve is self-cleaning in the vent hole due to the sealed cavity behind the vent opening. As the valve opens, the pressure build-up within the cavity escapes out the vent and forces out any solid matter which may have been trapped.

Tests have been conducted on the inline control valve according to FIGS. 8–10 to determine operational characteristics such as cracking pressure, closing pressure, and pressure drop across the valve at maximum flow. The testing assembly incorporated an air compressor, 1" air hose, 200 cfm flow meter, and a 4" air motor. The in-line valve assembly was placed directly behind the air motor. Two manual gages were placed in the test assembly; one before and one after the valve. These gages were checked prior to testing to assure a plus or minus 2 psi accuracy. A spring rate check was also conducted on the valve spring. The spring rate is 30 lbs per inch which produces 45 lbs of load on the seat in the valve assembly.

It was noted that at 70 psi, the valve begins to leak air but does not fully open until 75 psi is reached. The valve remains open at 75 psi with no oscillation. These cracking and closing pressures can be altered by changing either the spring rate or the preload on the spring. Cracking pressure can be obtained as low as 60 psi, and as high as 90 psi in the present assembly.

ANOTHER VALVE EMBODIMENT

Figure 11:
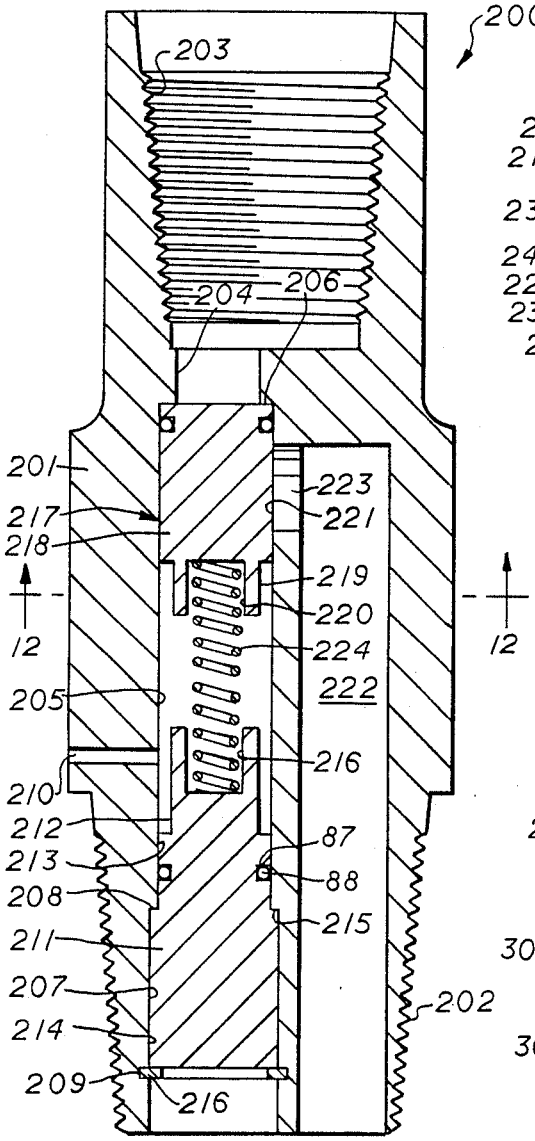
FIG. 11 is a longitudinal section of still another embodiment of the control valve.
Figure 12:
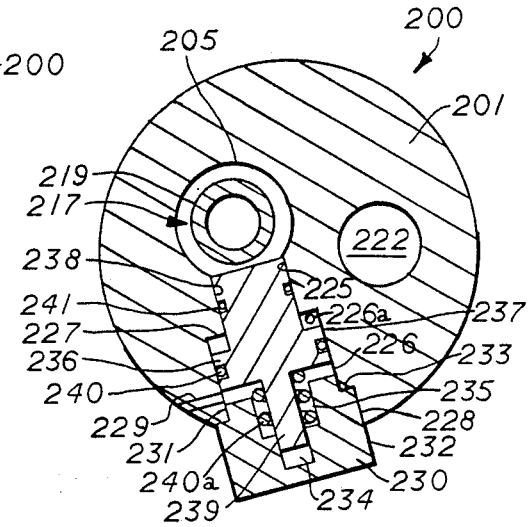
FIG. 12 is a transverse section of the embodiment of FIG. 11 showing a pilot operated trip piston mechanism.
Figure 13:
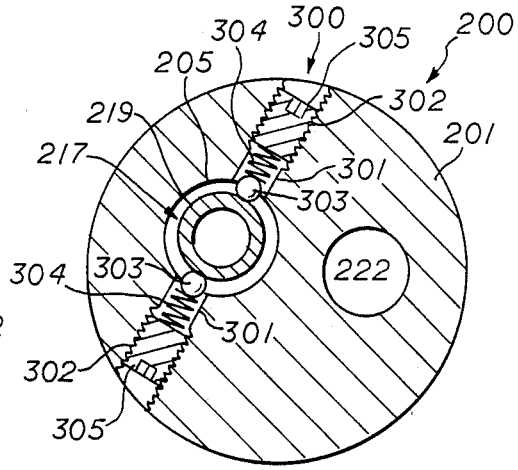
FIG. 13 is a transverse section of the embodiment of FIG. 11 showing a spring loaded ball detent trip piston mechanism.

FIGS. 11, 12 and 13 show another embodiment of the control valve having a latching feature referred to as a "switching" control valve 200 which will allow filling the empty supply hose or drill string to a pre-set pressure before the boring tool is supplied with compressed air. The "switching" valve 200 is a pilot operated valve utilizing a pilot operated piston or spring loaded ball detent mechanism which unlatches the valve piston at a predetermined pressure as described below.

The "switching" valve assembly 200 comprises a cylindrical valve body 201 having external male threads 202 on one end and female threads 203 on the opposed end. A longitudinal bore 204 extends inwardly from the female threaded end 203 laterally spaced from the central longitudinal axis, and an enlarged smooth bore 205 in axial alignment therewith extends inwardly from the male threaded end 202 of the body 201 to define a flat shoulder functioning as a valve seat between the bores 204 and 205. The lower portion of the enlarged bore 205 is inwardly counterbored at 207 to define a shoulder 208. A snap ring groove 209 is provided in the side wall of the counterbore 207 between the end of the body and the shoulder 208. A relief port 210 extends through the side wall of the body 201 between the shoulders 206 and 208 to communicate the enlarged bore 205 with atmosphere.

A spring retainer member 211 has a first portion 212 of a diameter spaced from the wall of bore 205, a second portion 213 of a diameter larger than the first slidably fitting bore 205, and a third portion 214 of a diameter larger than the second defining a shoulder 215 therebetween and slidable fitting bore 207. A cylindrical recess 216 extends inwardly a short distance from the end of first portion 212. The first portion 212 is smaller than the enlarged bore 205 of the body 201 to allow a fluid flow path therearound. The second portion 213 is slightly smaller than the enlarged bore 205 to be slidably received therein and the third enlarged portion 214 is slightly smaller than the counterbore 207 to be slidably received therein with the shoulders 208 and 215 serving engaging as stops.

Spring retaining member 211 fits inside the enlarged bore 205 and counterbore 207 of the valve body 201 and is releasably secured therein by means of a snap ring 216 fitted in groove 209. An annular groove 87 and O-ring seal 88 is provided on the second portion 213 forming a seal between the smooth enlarged bore 205 and the exterior of the spring retaining member 211.

A piston valve member 217 is positioned for sliding movement in the enlarged smooth bore 207. Piston 217 valve member comprises a cylindrical body 218 having a reduced diameter 219 at one end. A central recess 220 extends inwardly a short distance from the reduced diameter end. The larger diameter portion 221 of the piston body 218 is slightly smaller than the enlarged bore 205 of the valve body 201 and is slidably received therein for reciprocal movement. An annular groove 98 and O-ring seal 99 is provided on the enlarged diameter portion 221 forming a seal between the smooth enlarged bore 205 and the exterior of the piston body 218. The O-ring may alternatively be positioned in an annular groove in housing 217 and piston 218 provided with a chamfered end.

Another longitudinal bore 222 extends inwardly from the male threaded end, parallel to, and laterally spaced from the bore 205. A port 223 opens between the bores 205 and 222 to establish communication therebetween. Port 223 is disposed just below the seat 206 whereby the piston 217 in the closed position seals off communication between the two bores 205 and 222. A coiled compression spring 224 is compressed and has one end received in the spring retainer recess 216 and the other end received in the piston recess 220 to normally urge the piston 217 in a sealing relation in the bore 205 and against the seat 206 to close off the bore 204.

The pilot operated trip piston latching feature is shown in FIG. 12. A bore 225 extends laterally from the bore 205 through the side wall of the valve body 201 at the location of the reduced diameter 219 of the piston 217 in the closed position. An enlarged bore 226 in axial alignment therewith extends inwardly from the exterior of the valve body to define a stop shoulder 227 therebetween. A flat 228 is milled on the sidewall of the valve body at the outer end of bore 226. A relief port 229 extends from the enlarged bore 226 to the exterior of the valve body 201 to communicate the bore 226 with atmosphere. A passage **226*a* opens from enlarged bore 226 to the inlet side of the valve to communicate air line pressure into bore 226**.

A spring retainer cap 230 has a short cylindrical portion 231 at one end and a larger rectangular portion 232 at the other end defining a shoulder 233 therebetween. A small square recess 234 extends inwardly a distance from the smaller diameter end portion 231 and is counterbored at 235. The cylindrical portion 231 of cap 230 fits inside the enlarged bore 226 and the rectangular portion 232 is secured on the milled face 228 of the valve body 201 by conventional means such as threaded cap screws (not shown).

A trip piston member 236 is positioned for sliding movement in the enlarged bore 226. Trip piston 236 comprises a cylindrical body having a first enlarged diameter portion 237, a second reduced diameter portion 238 at one end having a milled flat for engaging the shoulder of piston 217 and a square extension 239 at the other end defining a flat shoulder therebetween. The first enlarged diameter portion 237 is slidably received in the enlarged bore 226 for reciprocal movement. An annular groove and O-ring seal 240 is provided on the enlarged diameter portion 237 forming a reciprocal seal between the enlarged bore 226 and the exterior of the piston body. The reduced diameter portion 238 is slightly smaller than the bore 225 and is slidably received therein for reciprocal movement. An annular groove and O-ring seal 241 is provided on the smaller diameter portion 238 forming a seal between the bore 225 and the reduced diameter 225 for reciprocal movement of said trip piston.

The square extension 239 of trip piston 236 is slidably received in the square recess 234 of the cap 230. A coiled compression spring **240*a* surrounds the extension 239 with one end received in the counterbore 235 and the opposed end engaging the flat lower shoulder of the piston to normally urge the inward end 238 of the piston into engagement against the reduced diameter 219 of the valve piston 217**.

As explained in detail hereinafter, the spring 224 maintains the valve piston 217 in the closed position, in the absence of compressed air within the drill pipe, closing off the down hole end of the drill string. The spring 240*a* maintains trip piston 236 against reduced diameter 219 of piston 217.

Once the drill string has been charged to a release pressure (approximately 70 psig) determined by the area of piston 236 and the strength of the spring 240*a*, the bore 226 is open to the supply of compressed air in the drill string by passageway 226*a* to move trip piston 236. At the release pressure, trip piston 236 is moved a sufficient distance to unlatch valve piston 217 which is then moved by air line pressure to open position to allow a surge of air pressure thereby supplying a high impulse of energy to effectively initiate the starting operation of the boring tool. The pistons remain open as long as compressed air continues to be supplied to the drill string. When air pressure is shut off, the pressure can no longer balance the force of the spring 224, the valve piston 217 moves to closed position and is again latched by trip piston 236 moving into latching as previously described.

FIG. 13 shows a spring loaded ball detent latching mechanism 300 which may be used in the control valve 200. A small bore 301 extends transversely through the center of the bore 205 to the side wall of the valve body 201 at the vertical location of the reduced diameter 219 of the piston 217 in the closed position. The bore 301 is threaded on the outer ends 302 inwardly from the exterior of the valve body. A ball 303, compression spring 304, and set screw 305 is received in the opposed ends of the bore 301. The springs 304 urge the balls 303 against the reduced diameter 219 and shoulder area of the valve-piston 217 to maintain it in the closed position, in the absence of compressed air within the drill pipe, closing off the down hole end of the drill string.

Once the drill string has been charged to a release pressure (approximately 70 psig) determined by the strength of springs 304, valve piston 217 forces the balls 303 to retract out of latching position and is moved by air line pressure to open position to allow a surge of air pressure thereby supplying a high impulse of energy to effectively initiate the starting operation of the boring tool. The piston remains open as long as compressed air continues to be supplied to the drill string. When air pressure is shut off, the pressure can no longer balance the force of the spring 224, the valve piston 217 moves to closed position and is again latched by the balls 303 moving into latch position as previously described.

OPERATION

As previously discussed, the percussive tool in particular requires a certain impulse of energy to initiate operation because of internal friction and leakage. This may be further aggravated by ineffective lubrication or frost conditions from air expansion within the tool. In cold atmospheric conditions, a percussion mole may freeze moisture in the tight seal areas. For the down hole motor, similar difficulties could occur from excessive drag on the drill bit.

The control valve of this embodiment of the invention is installed upstream of the boring tool in the drill string or on the flexible power supply hose of pneumatic percussive moles and allows the pressure to build-up before reaching the tool. At a predetermined pressure, the valve opens and allows air at operating pressure to immediately blast the hammer. This prevents the pressure from equalizing across the hammer and allows the tool to start. In cold atmospheric conditions, a percussion mole may freeze moisture in the tight seal areas. A high-pressure blast provided by the control valve will help break-up and remove the frozen moisture and allow the tool to operate. This technique also applies to borehole water that has flowed into the percussion mole. The valve provides an air blast which forces a majority of the water out and allows the tool to start.

In the operation of the embodiment of FIGS. 11, 12 and 13, the spring 224 maintains the valve piston 217 in the closed position in the absence of compressed air within the drill pipe closing off the down hole end of the drill string. When adding a section of drill pipe and in the absence of compressed air within the drill pipe, the spring moves the valve piston toward the drilling frame and closes off bores 204 and 222 to the down hole end of the drill string. Spring 240 moves trip piston 236 (FIG. 12), or in the alternative, the balls 303 are moved by springs 304 (FIG. 13) against the reduced diameter 219 of valve piston 217.

Once the drill string has been reassembled, valve is opened to resume operations of the down hole boring tool. The control valve 200 however, prevents compressed air from reaching the tool until the drill string has been charged to a release pressure (about 70 psig) determined by the area of piston 236 and the strength of spring 240. Note that bore 226 is open to the supply of compressed air in the drill string by passageway 226*a* (FIG. 12). Alternatively, the release pressure is determined by the strength of springs 304 (FIG. 13). At the release pressure, piston 236, or balls 303, retract sufficiently to unlatch piston 217. Air pressure against the face of valve piston 217 causes it to compress spring 224, thus automatically opening the control valve to supply the closely connected boring tool with a high impulse of energy to effectively initiate its operation.

The control valve 200 remains open as long as compressed air continues to be supplied to the drill string. When the control valve is closed, for example, to add yet another joint of drill pipe, compressed air continues to flow out of the drill string to the boring tool until air pressure can no longer balance the force of spring 224. Spring 224 then moves valve piston 217 to closed position. Valve piston 217 is again latched by trip piston 236 or the spring loaded balls 303 as described at the beginning of this operational sequence. Any retained compressed air in the drill string is vented when another joint of pipe is added or removed.

While this invention has been described fully and completely with special emphasis upon several preferred embodiments of the invention it should be understood that within the scope of the appended claims the invention may be practiced otherwise than as specifically described above.

We claim:

1. An apparatus for boring holes in the earth comprising a pneumatically operated earth boring tool having an inlet for introduction of pneumatic fluid to operate said tool, conduit means having one end connected to said tool and another end adapted to be connected to a source of pneumatic fluid, said tool including earth boring means on one end thereof and a reciprocally movable hammer positioned in said tool to apply a percussive force to said earth boring means, valve means positioned in said conduit means substantially adjacent to said tool between said tool and said source of pneumatic fluid controlling the flow of pneumatic fluid through said conduit means to said tool, said valve means including pneumatic pressure operated valve means operable in response to the pressure of pneumatic fluid in said conduit means to be opened to permit flow of pneumatic fluid to said tool only on attaining a predetermined operating pressure in said conduit means to transmit an initial pulse of pneumatic fluid to initiate operation of said hammer, and said pneumatic pressure operated valve means being maintained open at a predetermined lower conduit means pressure than that required to open the same.

2. An earth boring apparatus according to claim 1 in which said pneumatic pressure operated valve means comprises a pressure-operated valve, spring-loaded toward closed position and opening at a first predetermined pneumatic pressure in said conduit means permitting flow through said conduit means to said tool and closing at a second, substantially lower, predetermined pneumatic pressure in said conduit means.

3. An earth boring apparatus according to claim 1 in which said pneumatic pressure operated valve means comprises a valve, spring-loaded toward closed position, and opening in response to pneumatic conduit pressure, a pneumatic pressure operated latch to secure said valve in a closed position, said valve and pneumatic pressure operated latch being opened at a first predetermined pneumatic pressure and closing at a second, substantially lower, predetermined pneumatic pressure

4. An earth boring apparatus according to claim 1 in which said pneumatic pressure operated valve means comprises a valve, spring-loaded toward closed position, and opening in response to pneumatic conduit pressure a spring pressure operated latch to secure said valve in a closed position, said valve and spring pressure operated latch being opened at a first predetermined pneumatic pressure and closing at a second, substantially lower, predetermined pneumatic pressure.

5. An earth boring apparatus according to claim 2 in which said pneumatic pressure-operated valve means comprises a tubular housing having an inlet at one end and an outlet at the other end, a longitudinal passageway through said housing including a valve port and seat at the inlet end, an enlarged portion in said passageway on the outlet side of said valve port, a piston valve member positioned for reciprocal sliding movement in said enlarged passageway portion, said piston valve member having a diameter larger than said valve port and an end portion movable to closed or to open position relative to said valve seat, spring means engaging said piston valve member and biasing it toward closed position, said housing having vent openings through its wall from said enlarged passageway portion at a point intermediate said valve port and said outlet, and means sealing said piston valve member relative to said enlarged passageway portion on opposite sides of said vent openings, said piston valve member being opened by the pressure differential between the inlet side of said valve port and said housing outlet and being maintained open by the differential pressure between the inlet side of said piston valve member, when open, and the pressure outside said vent holes.

6. An earth boring apparatus according to claim 5 in which said housing is substantially cylindrical with male threads at one end and female threads at the other end for connection in a drill string.

7. An earth boring apparatus according to claim 5 in which said housing is substantially cylindrical with threaded portions at each end for connection to a flexible conduit or air hose.

8. An earth boring apparatus according to claim 5 in which said housing is a substantially cylindrical cartridge with a peripheral enlargement adjacent to the outlet end, and shaped to fit inside a drill pipe or collar.

9. An earth boring apparatus according to claim 5 in which said piston valve member comprises a piston portion of enlarged diameter having a sliding fit in said enlarged passageway portion, a smaller diameter portion on one side with an end portion providing a valve engageable with said valve seat to open and close the same, a hollow tubular guide extension on the other side, and openings through said smaller diameter portion into the interior of said hollow tubular guide extension, said openings and tubular guide extension providing a passage through said valve in the opened position, the outlet end of said housing having guide surface means receiving said tubular guide extension in a sliding relation to guide longitudinal movement of said valve member, said spring means comprising a coil spring surrounding said tubular guide extension and compressed between said piston portion and said guide surface means, said housing vent openings being located at a point intermediate said piston portion and guide surface means, and said sealing means comprising a peripheral seal between said piston portion and said enlarged passageway and a peripheral seal between said tubular guide extension and said guide surface.

10. An earth boring apparatus according to claim 9 in which said guide surface means comprises a tubular sleeve member positioned in the outlet end portion of said enlarged passageway portion, and including means retaining said tubular sleeve in position, and a peripheral seal between said tubular sleeve and the wall of said enlarged passageway portion.

11. An earth boring apparatus according to claim 5 in which said housing is formed in two parts comprising an inlet end part and an outlet end part, means retaining said housing parts together, said piston valve member comprises a piston portion of enlarged diameter having a sliding fit in said enlarged passageway portion, a smaller diameter portion on one side with an end portion providing a valve engageable with said valve seat to open and close the same, a hollow tubular guide extension on the other side, and openings through said smaller diameter portion into the interior of said hollow tubular guide extension, said openings and tubular guide extension providing a passage through said valve in the opened position, a tubular sleeve portion on said housing outlet end part extending inside said housing inlet end part providing a guide surface receiving said tubular guide extension in a sliding relation to guide longitudinal movement of said valve member, said spring means comprising a coil spring surrounding said tubular guide extension and compressed between said piston portion and said housing sleeve portion, said housing vent openings being located at a point intermediate said piston portion and said housing sleeve portion, and said sealing means comprising a peripheral seal between said piston portion and said enlarged passageway and a peripheral seal between said tubular guide extension and said guide surface.

12. An earth boring apparatus according to claim 11 in which said housing portions are secured together by a threaded connection.

13. An earth boring apparatus according to claim 11 in which said housing portions are secured together by dowel pins.

14. An earth boring apparatus according to claim 12 in which said housing is substantially cylindrical with threaded portions at each end for connection to a flexible conduit or air hose.

15. An earth boring apparatus according to claim 13 in which said housing is a substantially cylindrical cartridge with a peripheral enlargement adjacent to the outlet end, and shaped to fit inside a drill pipe or collar.

16. An earth boring apparatus according to claim 3 in which said pneumatic pressure operated latch comprises a piston mounted in said valve housing for movement into and out of latching engagement with said valve piston to secure said valve in an open position, said valve and pneumatic pressure operated latch being exposed to inlet pneumatic pressure to open at a first predetermined pneumatic pressure and close at a second, substantially lower, predetermined pneumatic pressure.

17. An earth boring apparatus according to claim 3 in which said pneumatic pressure-operated valve means comprises a tubular housing having an inlet at one end and an outlet at the other end, a longitudinal passageway through said housing including a valve port and seat at the inlet end, a piston valve member positioned for reciprocal sliding movement in said passageway, a first spring retainer member spaced longitudinally from said piston valve member, spring means compressed between .said piston valve member and said spring retainer member and biasing said valve member toward closed position, said housing having a vent opening through its wall at a point intermediate said piston valve member and said spring retainer member, means sealing said piston valve member and said spring retainer member relative to said passageway on opposite sides of said vent openings, said housing having a bore extending laterally into said passageway below said piston valve member when said valve is closed, a latch piston positioned for reciprocal movement in said bore, a second spring retainer member spaced from said latch piston and closing the outer end of said bore, a spring compressed between said second spring retainer member and said latch piston biasing said latch piston toward said piston valve member, a passageway extending from the inlet side of said housing to said latch piston to apply a pneumatic force to move the same out of latching engagement with said valve piston to permit said valve to open, said piston valve member being opened by the pressure differential between the inlet side of said valve port and said housing outlet and being maintained open by the differential pressure between the inlet side of said piston valve member, when open, and the pressure outside said vent holes.

18. An earth boring apparatus according to claim 17 in which said housing has a wall at the inlet end with an opening therethrough forming said valve port and valve seat, said longitudinal passageway includes parallel passageway portions, one passageway portion extending from said valve port, and the other passageway portion extending from said wall to the outlet from said valve, an opening from said one passageway portion to the other portion adjacent to said valve port and seat and closed and opened by movement of said piston valve member, and said latch piston preventing opening movement of said piston valve member until sufficient pneumatic pressure is applied to move said latch piston out of latching position.

19. An earth boring apparatus according to claim 4 in which said spring pressure operated latch comprises a one or more ball members mounted in said valve housing and biased by spring members for movement into and out of latching engagement with said valve piston to secure said valve in a closed position, said valve being exposed to inlet pneumatic pressure to open at a first predetermined pneumatic pressure sufficient to overcome the force of said spring members and close at a second, substantially lower, predetermined pneumatic pressure.

20. An earth boring apparatus according to claim 4 in which said pneumatic pressure-operated valve means comprises a tubular housing having an inlet at one end and an outlet at the other end, a longitudinal passageway through said housing including a valve port and seat at the inlet end, a piston valve member positioned for reciprocal sliding movement in said passageway, a first spring retainer member spaced longitudinally from said piston valve member, spring means compressed between said piston valve member and said spring retainer member and biasing said valve member toward closed position, said housing having a vent opening through its wall at a point intermediate said piston valve member and said spring retainer member, means sealing said piston valve member and said spring retainer member relative to said passageway on opposite sides of said vent openings, said housing having at least one bore extending laterally into said passageway below said piston valve member when said valve is closed, at least one ball member positioned for reciprocal movement in said bore, a spring retainer removably positioned in said bore enclosing the outer end of said bore and spaced from said ball member, a spring compressed between said second spring retainer member and said ball biasing said ball toward said piston valve member to move the same out of latching engagement with said valve piston to permit said valve to open, said piston valve member being opened by the pressure differential between the inlet side of said valve port and said housing outlet and being maintained open by the differential pressure between the inlet side of said piston valve member, when open, and the pressure outside said vent holes.

21. An earth boring apparatus according to claim 20 in which said housing has a wall at the inlet end with an opening therethrough forming said valve port and valve seat, said longitudinal passageway includes parallel passageway portions, one passageway portion extending from said valve port, and the other passageway portion extending from said wall to the outlet from said valve, an opening from said one passageway portion to the other portion adjacent to said valve port and seat and closed and opened by movement of said piston valve member, and said ball member preventing opening movement of said piston valve member until sufficient pneumatic pressure is applied to said valve piston to overcome the spring force biasing said ball toward said piston valve member to move the same out of latching position.

22. A method of boring holes in the earth which comprises providing a pneumatically operated earth boring tool having an inlet for admission of pneumatic fluid for operating said tool, providing a source of pneumatic fluid and conduit means from said tool inlet to said source of pneumatic fluid, said tool including earth boring means on one end thereof and reciprocally movable hammer positioned in said tool to apply a percussive force to said earth boring means on application of pneumatic fluid pressure thereto, applying said pneumatic fluid to said tool to operate said hammer, and automatically restraining said application of pneumatic fluid to said tool until the pneumatic pressure in said conduit means adjacent to said hammer has reached a predetermined level so that the initial application of pneumatic fluid form said conduit to said hammer is as a pulse of pneumatic fluid to initiate hammer movement.

23. A method according to claim 22 in which said step of restraining application of pneumatic fluid is carried out by providing valve means positioned in said conduit means substantially adjacent to said tool between said tool inlet and said source of pneumatic fluid controlling the flow of pneumatic fluid to said tool, said valve means including pneumatic pressure operated valve means operable in response to the pressure of pneumatic fluid in said conduit means to be opened to permit flow of pneumatic fluid to said tool at a predetermined operating pressure in said conduit means to transmit an initial pulse of pneumatic fluid from said conduit means to initiate operation of said hammer, and applying sufficient pneumatic fluid pressure from said conduit means to said valve means to open the same, said pneumatic pressure operated valve means being maintained open at a predetermined lower pressure in said conduit means than that required to open the same.

24. A method according to claim 23 in which said pneumatic pressure operated valve means comprises a pressure-operated valve, spring-loaded toward closed position and opening at a first predetermined pneumatic pressure in said conduit means permitting flow through said conduit means to said tool inlet and closing at a second, substantially lower, predetermined pneumatic pressure in said conduit means.

25. A method according to claim 23 in which said pneumatic pressure operated valve means comprises a valve, spring-loaded toward closed position, and opening in response to pneumatic conduit pressure, a pneumatic pressure operated latch to secure said valve in a closed position, said valve and pneumatic pressure operated latch being opened at a first predetermined pneumatic pressure and closing at a second, substantially lower, predetermined pneumatic pressure.

26. A method according to claim 23 in which said pneumatic pressure operated valve means comprises a valve, spring-loaded toward closed position, and opening in response to pneumatic conduit pressure, a spring pressure operated latch to secure said valve in a closed position, said valve and spring pressure operated latch being opened at a first predetermined pneumatic pressure and closing at a second, substantially lower, predetermined pneumatic pressure.

27. A method according to claim 24 in which said pneumatic pressure-operated valve means comprises a tubular housing having an inlet at one end and an outlet at the other end, a longitudinal passageway through said housing including a valve port and seat at the inlet end, an enlarged portion in said passageway on the outlet side of said valve port, a piston valve member positioned for reciprocal sliding movement in said enlarged passageway portion, said piston valve member having a diameter larger than said valve port and an end portion movable to closed or to open position relative to said valve seat, spring means engaging said piston valve member and biasing it toward closed position, said housing having vent openings through its wall from said enlarged passageway portion at a point intermediate said valve port and said outlet, means sealing said piston valve member relative to said enlarged passageway portion on opposite sides of said vent openings, and applying pressure to said inlet whereby said piston valve member is opened by the pressure differential between the inlet side of said valve port and said housing outlet and maintained open by the differential pressure between the inlet side of said piston valve member, when open, and the pressure outside said vent holes.

28. A method according to claim 25 in which said pneumatic pressure-operated valve means comprises a tubular housing having an inlet at one end and an outlet at the other end, a longitudinal passageway through said housing including a valve port and seat at the inlet end, a piston valve member positioned for reciprocal sliding movement in said passageway, a first spring retainer member spaced longitudinally from said piston valve member, spring means compressed between said piston valve member and said spring retainer member and biasing said valve member toward closed position, said housing having a vent opening through its wall at a point intermediate said piston valve member and said spring retainer member, means sealing said piston valve member and said spring retainer member relative to said passageway on opposite sides of said vent openings, said housing having a bore extending laterally into said passageway below said piston valve member when said valve is closed, a latch piston positioned for reciprocal movement in said bore, a second spring retainer member spaced from said latch piston and closing the outer end of said bore, a spring compressed between said second spring retainer member and said latch piston biasing said latch piston toward said piston valve member, a passageway extending from the inlet side of said housing to said latch piston to apply a pneumatic force to move the same out of latching engagement with said valve piston to permit said valve to open, applying pressure to said inlet whereby said piston valve member is opened by the pressure differential between the inlet side of said valve port and said housing outlet and maintained open by the differential pressure between the inlet side of said piston valve member, when open, and the pressure outside said vent holes.

29. A method according to claim 26 in which said spring pressure operated latch comprises a one or more ball members mounted in said valve housing and biased by spring members for movement into and out of latching engagement with said valve piston to secure said valve in a closed position, said valve being exposed to inlet pneumatic pressure to open at a first predetermined pneumatic pressure sufficient to overcome the force of said spring members and close at a second, substantially lower, predetermined pneumatic pressure.

30. A method according to claim 26 in which said pneumatic pressure-operated valve means comprises a tubular housing having an inlet at one end and an outlet at the other end, a longitudinal passageway through said housing including a valve port and seat at the inlet end, a piston valve member positioned for reciprocal sliding movement in said passageway, a first spring retainer member spaced longitudinally from said piston valve member, spring means compressed between said piston valve member and said spring retainer member and biasing said valve member toward closed position, said housing having a vent opening through its wall at a point intermediate said piston valve member and said spring retainer member, means sealing said piston valve member and said spring retainer member relative to said passageway on opposite sides of said vent openings, said housing having at least one bore extending laterally into said passageway below said piston valve member when said valve is closed, at least one ball member positioned for reciprocal movement in said bore, a spring retainer removably positioned in said bore enclosing the outer end of said bore and spaced from said ball member, a spring compressed between said second spring retainer member and said ball to bias said ball into engagement with said piston valve member to prevent opening movement of the same until sufficient pneumatic pressure is applied to said piston valve member to overcome the spring force biasing said ball into engagement and move the same out of latching engagement with said piston valve to permit said valve to open, said piston valve member being opened by the pressure differential between the inlet side of said valve port and said housing outlet and being maintained open by the differential pressure between the inlet side of said piston valve member, when open, and the pressure outside said vent holes.

31. A method according to claim 30 in which said housing has a wall at the inlet end with an opening therethrough forming said valve port and valve seat, said longitudinal passageway includes parallel passageway portions, one passageway portion extending from said valve port, and the other passageway portion extending from said wall to the outlet from said valve, an opening from said one passageway portion to the other portion adjacent to said valve port and seat and closed and opened by movement of said piston valve member, and said ball member preventing opening movement of said piston valve member until sufficient pneumatic pressure is applied to said valve piston to overcome the spring force biasing said ball toward said piston valve member to move the same out of latching position.

* * * * *